US006513776B1

(12) United States Patent
Bissett

(10) Patent No.: US 6,513,776 B1
(45) Date of Patent: Feb. 4, 2003

(54) HAND TOOL FOR SECURELY SUPPORTING ARTICLE DURING PAINTING

(76) Inventor: Mark G. Bissett, 4104 Morningwood Dr., Olney, MD (US) 20832

( * ) Notice: Subject to any disclaimer, the term of this patent is extended or adjusted under 35 U.S.C. 154(b) by 0 days.

(21) Appl. No.: 09/310,155

(22) Filed: May 12, 1999

(51) Int. Cl.[7] ..... A47F 5/00

(52) U.S. Cl. ..... 248/309.1; 248/309.4; 248/300; 248/301; 248/206.5; 224/677; 173/171; D8/349; D8/355

(58) Field of Search ..... 248/309.1, 309.4, 248/206.5, 300, 301, 304, 339; D8/349, 355, 366; 173/171, 162.1; 224/677

(56) References Cited

U.S. PATENT DOCUMENTS

| | | | | | |
|---|---|---|---|---|---|
| 1,214,119 | A | * | 1/1917 | Bayne | 248/309.1 |
| 2,551,769 | A | * | 5/1951 | Sieben | 248/300 |
| 2,676,778 | A | * | 4/1954 | Pace et al. | 248/300 |
| 3,174,628 | A | | 3/1965 | Kirch, Jr. | 211/123 |
| 3,565,382 | A | * | 2/1971 | Passarelli, Jr. | 248/300 |
| 3,969,620 | A | | 7/1976 | Brooks | 240/7.5 |
| D275,264 | S | | 8/1984 | Wegener, II | D8/373 |
| 4,467,486 | A | * | 8/1984 | Schatz | 248/300 |
| 4,682,562 | A | | 7/1987 | Hell | 118/500 |
| 4,746,780 | A | * | 5/1988 | Resh | 248/300 |
| 5,081,952 | A | | 1/1992 | Grassi et al. | 118/500 |
| D331,529 | S | * | 12/1992 | Reinklou | D8/73 |
| 5,180,019 | A | * | 1/1993 | Thiry et al. | 173/168 |
| 5,195,710 | A | * | 3/1993 | Remblier | 248/300 |
| 5,296,030 | A | | 3/1994 | Young | 118/500 |
| 5,427,618 | A | | 6/1995 | Haddix et al. | 118/500 |
| 5,529,273 | A | * | 6/1996 | Benthin | 248/254 |
| 5,607,069 | A | | 3/1997 | Stroobants et al. | 211/113 |
| 5,653,805 | A | | 8/1997 | Russell et al. | 118/503 |
| 5,660,637 | A | | 8/1997 | Dodge | 118/500 |
| 5,720,817 | A | | 2/1998 | Taylor | 118/500 |
| 5,810,232 | A | * | 9/1998 | Meurer et al. | 224/677 |
| 5,810,303 | A | * | 9/1998 | Bourassa et al. | 248/205.1 |
| 5,897,086 | A | * | 4/1999 | Condon | 248/220.1 |
| 6,010,103 | A | * | 1/2000 | Ashworth | 248/301 |

* cited by examiner

*Primary Examiner*—Kimberly Wood
(74) *Attorney, Agent, or Firm*—Paul E. Steiner

(57) ABSTRACT

A hand tool for securely supporting an article during painting includes a mounting portion adapted to secure the article thereto, a handle portion connected to the mounting portion, the handle portion being adapted to be grasped by an operator, and a supporting portion connected to the handle portion, the supporting portion being adapted to support the article after a painting operation is completed and while the paint dries. The hand tool may be of a general "L" shape or a general "T" shape. Preferably, the hand tool is of one-piece construction.

7 Claims, 7 Drawing Sheets

HAND TOOL FOR SECURELY SUPPORTING ARTICLE DURING PAINTING

BACKGROUND

1. Field of the Invention

The invention relates generally to fixtures for supporting articles during spray painting such as painting racks for vehicle parts and the like. More specifically, the invention relates to a hand tool for securely supporting small articles during spray painting.

2. Related Art

During the life of a vehicle, such as an automobile, it may become necessary or desirable to paint or re-paint one or more parts for the vehicle. Such work is typically performed in paint shops including, for example, body shops, collision shops, and other specialty paint shops. Paint shops may have one or more spray painting chambers, each equipped with a variety of floor standing racks and other wall mounted or ceiling mounted fixtures for supporting vehicle body parts during painting and the subsequent drying or curing of the painted parts.

For example, U.S. Pat. No. 5,296,030 discloses a painting rack for vehicle parts which includes a floor standing frame on wheels. The frame is made from welded tubular cross members which define a plurality of hole portions which accept rod-like extensions adapted to support various vehicle body parts. U.S. Pat. No. 5,607,069 discloses a paint rack with modular crossbars for use in a conveyor system. The crossbars may be equipped with hangers to support articles during painting. U.S. Pat. No. 5,660,637 discloses a adjustable paint rack with a tubular metal frame with re-positionable wheels for use or storage as needed. U.S. Pat. No. 5,720,817 discloses a paint rack include a base frame on casters with oppositely disposed end supports secured to oppositely disposed side supports. The rack is adapted to utilize a variety of cross members and support bars for holding a plurality of vehicle parts for painting.

Floor standing paint rack systems are commercially available from, for example, Brut Manufacturing (Navaire, Ohio), Paint and Body Equipment (P.B.E., Spencerville, Ohio), and Leezer Products (A.B.E. Enterprises, Largo, Fla.).

Such conventional paint rack systems are reasonably well adapted for securely positioning large vehicle parts such as doors, hoods, bumpers, and other body panels. Today's automobiles, however, include a wide variety of relatively small body parts. Such small body parts include, for example, mirror assemblies, mud flaps, and other trim pieces. Such parts are often painted to match or coordinate with the vehicle body color. As hereinafter described, the painting of such small articles may be awkward and inefficient on conventional paint racks.

SUMMARY OF THE INVENTION

It is an object of the invention to provide an apparatus and a method for spray painting small articles. It is another object of the invention to provide a hand tool for securely supporting an article during spray painting.

Typically, small articles which require painting are hung from conventional spray chamber fixtures on hangers, hooks, chains, and the like. When so hung, the articles are not securely positioned and may shift, move, or even fall during the spray painting process. Specifically, the spray gun used for spray painting produces a pressurized spray which is forceful enough to knock small parts of the rack. Mirror assemblies may be held or hung by the electrical wires protruding from the assembly. In this circumstance, the operator has to "chase" the mirror as it is constantly displaced from the force of the spray. Also, a mirror assembly can weigh as much as 15 to 20 pounds (7 to 14 kg). This weight can cause significant stress on the electrical connection when hung by the wires.

Even if the article is securely positioned on a rack, the painting operation is not efficient. The floor space in the spray painting chamber is a limited resource. Often an entire repair job consists of only a single small article, due to a minor accident. For example, mirrors are frequently damaged by collisions with a side of a garage door opening. Mud flaps are frequently damaged by collisions with a curb. Use of a large floor standing rack is an inefficient use of such space for painting a small article. Also, floor standing racks may be partially disassembled and stored when not in use. Setting up the rack may be a time-consuming procedure. Moreover, such small articles have complex shapes with many curves and angles. It is difficult to position the article in a manner so that it can be painted without extensive walking movement of the spray gun operator. Because of the size and bulk of conventional paint racks, such movement can be awkward and even dangerous due to the tripping hazard presented by the rack. Depending on the lighting in the chamber, shadows may make it difficult to inspect the article for an even application of paint over the complex shape, sometimes resulting in an inferior quality paint job.

The present invention overcomes the foregoing problems by providing a hand tool to which relatively small articles may be securely fastened. The operator holds the tool in one hand while operating the spray gun with the other hand. The hand tool further provides a supporting means which cooperates with a floor standing rack or other wall or ceiling mounted fixture to support the article while the paint dries.

The hand tool according to the invention is small in size and easily stored when not in use. Moreover, the hand tool according to the invention eliminates the need for setting up a separate floor standing paint rack for painting small articles, thereby facilitating an efficient use of floor space in the spray chamber and saving set-up time.

Because the article to be painted is held securely to the hand tool, the article does not shift or move due to the pressurized spray of the gun, thereby avoiding "chasing" of the article, shifting of the article, or knocking the article off the rack during painting. Most advantageously, the hand tool according to the invention provides a large degree of freedom of movement and maneuverability of the article during the spray painting process. This maneuverability allows the operator to stand in one place and position the article relative to the spray gun as desired or needed during painting, thereby reducing the time required to paint the article, improving the inspection and quality of the paint job, and further increasing the efficiency of the painting process.

The above and other objects of the invention are accomplished by a hand tool for securely supporting an article during painting, the hand tool including a mounting portion adapted to secure the article thereto, a handle portion connected to the mounting portion, the handle portion being adapted to be grasped by an operator, and a supporting portion connected to the handle portion, the supporting portion being adapted to support the article after a painting operation is completed and while the paint dries. The hand tool may be either of a general "L" shape or a general "T" shape. Preferably, the mounting portion, the handle portion, and the supporting portion are of one-piece construction.

In one example, the mounting portion includes a planar bracket defining an elongated slot adapted to receive a fastener therethrough for securing the article to the bracket. The bracket may define a plurality of elongated slots. In another example, the mounting portion defines at least one notch therein. In yet another example, the mounting portion defines an angle other than a right angle with respect to the handle portion.

Examples of the handle portion include either a flat strip, a wooden handle, or a tubular metal handle. The handle portion may include at least one post extending therefrom. In one example, the handle portion defines a recessed channel therein. The hand tool may further include a defined grip portion in the area of the handle portion.

The supporting portion may include a bore through the handle portion. Alternatively, the supporting portion may include at least one of a hook, a pin, and a peg.

According to another aspect of the invention, a hand tool for securely supporting an article during painting includes means for securing the article to the hand tool, means for grasping the hand tool, the grasping means being connected to the securing means, and means for supporting the hand tool and the article after a painting operation is completed and while the paint dries, the supporting means being connected to one of the securing means and the grasping means. Preferably, the securing means, the grasping means, and the supporting means are of one piece construction. The securing means may include means for receiving a fastener. The grasping means may include means for securing a cord of the article during painting. The supporting means may include means for hanging the hand tool and article during drying. Alternatively, the supporting means may include means for supporting the hand tool and article in an at least partially up-right position during drying. Without limiting the types of article suitable for use with the invention, the article may be either a mirror assembly, a mud flap, or a body trim piece.

The above objects and features of the invention are achieved individually and in combination. The invention should not be construed as requiring two or more of these features unless expressly required by the claims.

BRIEF DESCRIPTION OF THE DRAWINGS

The invention will be better understood upon consideration of the following detailed description in view of the accompanying drawings wherein.

DETAILED DESCRIPTION

Figure 1:
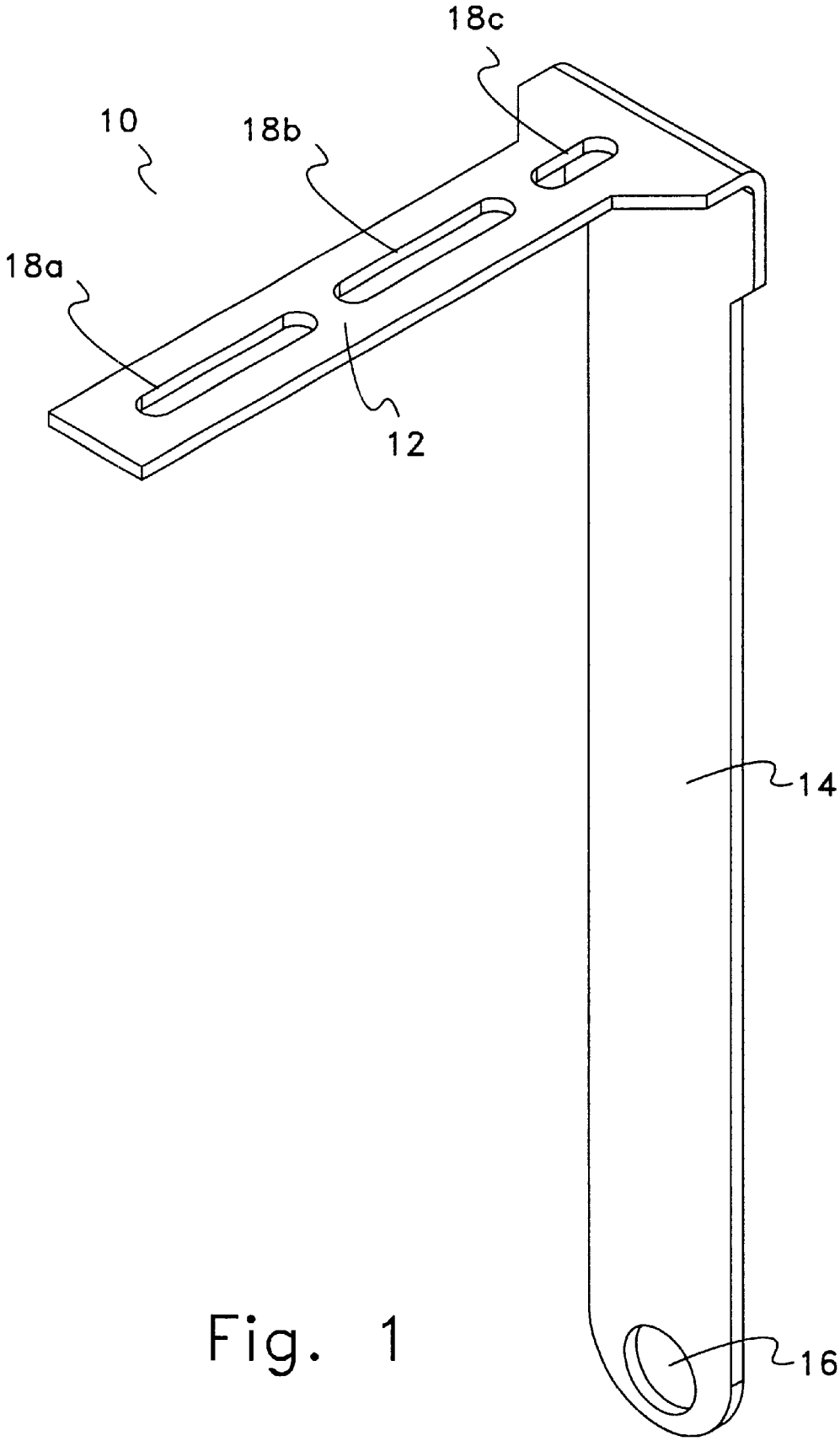
FIG. 1 is a perspective view of a first example of a hand tool according to the invention.
Figure 2A:
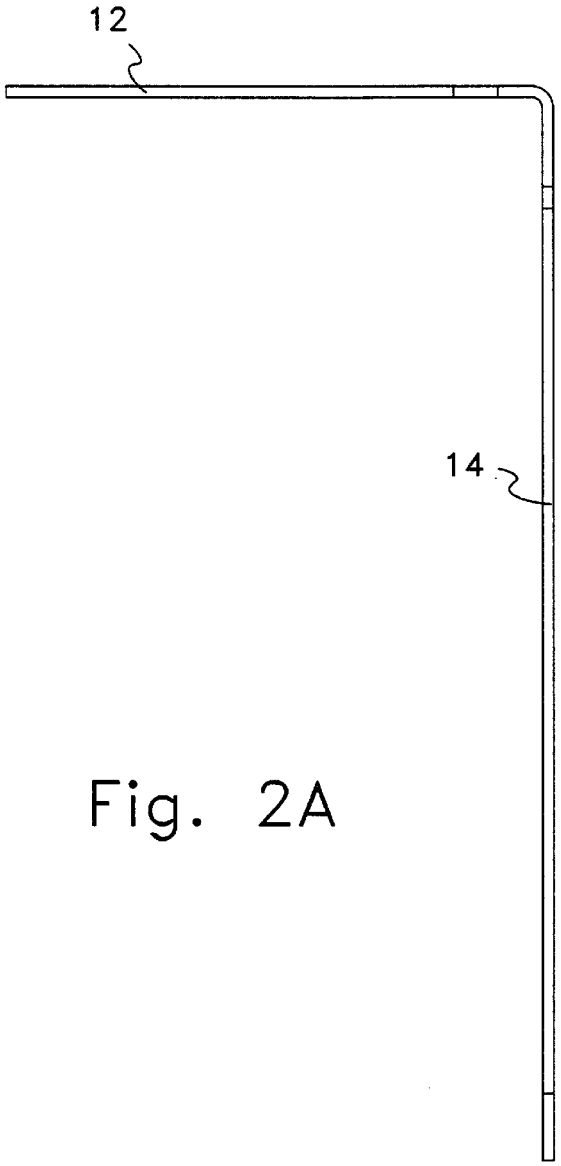
FIG. 2A is a side, schematic view of the first example.
Figure 2B:
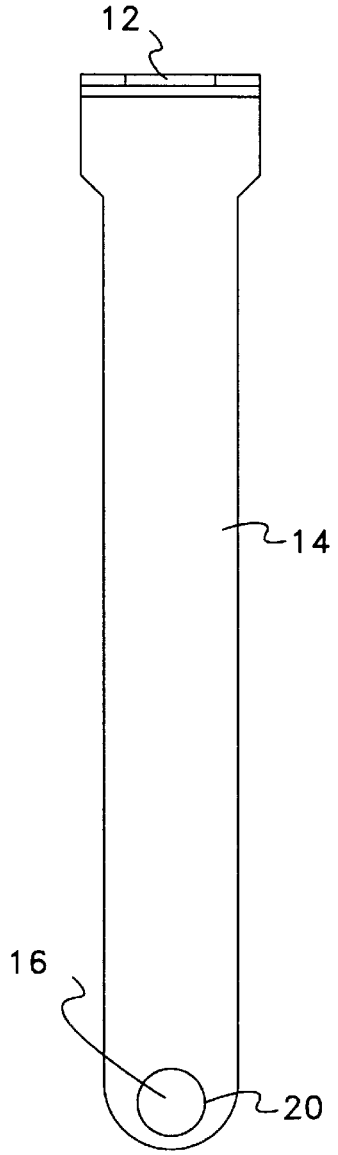
FIG. 2B is a front, schematic view of the first example.
Figure 2C:
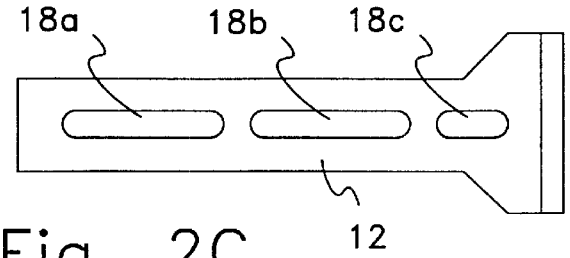
FIG. 2C is a top, schematic view of the first example.

With reference to FIGS. 1–2C, perspective, side, front, and top views, respectively, illustrate a first example of a hand tool according to the invention, with like numerals referencing like features. The hand tool, designated generally as hand tool 10, includes a mounting portion 12, a handle portion 14, and a supporting portion 16. The mounting portion 12 includes a plurality of slots 18*a–c*. The slots 18*a–c* are axially aligned and provide a location to secure the article to be painted to the hand tool 10. The handle portion 14 is an elongated flat strip of a size which is adapted to be manually grasped by an operator. The supporting portion 16 includes a bore 20 through an end of the handle portion 14 (distal to the mounting portion 12) for hanging the hand tool 10 on a hook, hanger, post, or the like when the spraying process is complete.

In the first example, the hand tool 10 is a one-piece construction preferably made from metal about ⅛ inch (3 mm) thick and bent in a general "L" shape with the longer leg of the "L" forming the handle portion 14 and the shorter leg of the "L" forming the mounting portion 12. A one-piece construction may be more economical to manufacture in volume as compared to the two piece construction shown in FIG. 5, for example. The mounting portion 12 is about 6 inches (150 mm) long and the handle portion 14 and supporting portion 16 together are about 12 inches (300 mm) long. The hand tool 10 is milled, drilled, or otherwise machined by conventional means to provide the slots 18*a–c,* the bore 20, and the other illustrated features. Generally, the construction of the hand tool 10 and the other hand tools according to the invention hereinafter described is readily apparent to those of ordinary skill in the art using the drawings and description provided herein.

The mounting portion 12 and the handle portion 14 may be configured to be of any useful length. Embodiments have been constructed with handles as short as 4 inches (100 mm). However, a longer handle tends to counterbalance the weight of the article being painted and improves the balance and maneuverability during painting. A longer handle also reduces the amount of over-spray on the operators hand, thereby reducing the risk of solvent contact on inadvertently exposed skin. The slots need not be axially aligned, but may have any useful configuration. Likewise, the bore 20 may be configured to be of any useful diameter and is preferably ½ inch (13 mm) or more. A larger bore eases the hanging of the hand tool when the spray painting is completed.

The hand tool 10 may be made from any useful material which is capable of withstanding the temperature of the paint curing process (typically 150° F. to 175° F. or 65° C. to 80° C.) and is resistant to paint solvents. The material must also provide sufficient strength to support the article during painting. Suitable materials include metal, wood, plastic, ceramic, and composites. Plastics which are broken down by the paint solvents are not preferred. Metal and wood are preferred materials.

Figure 3A:
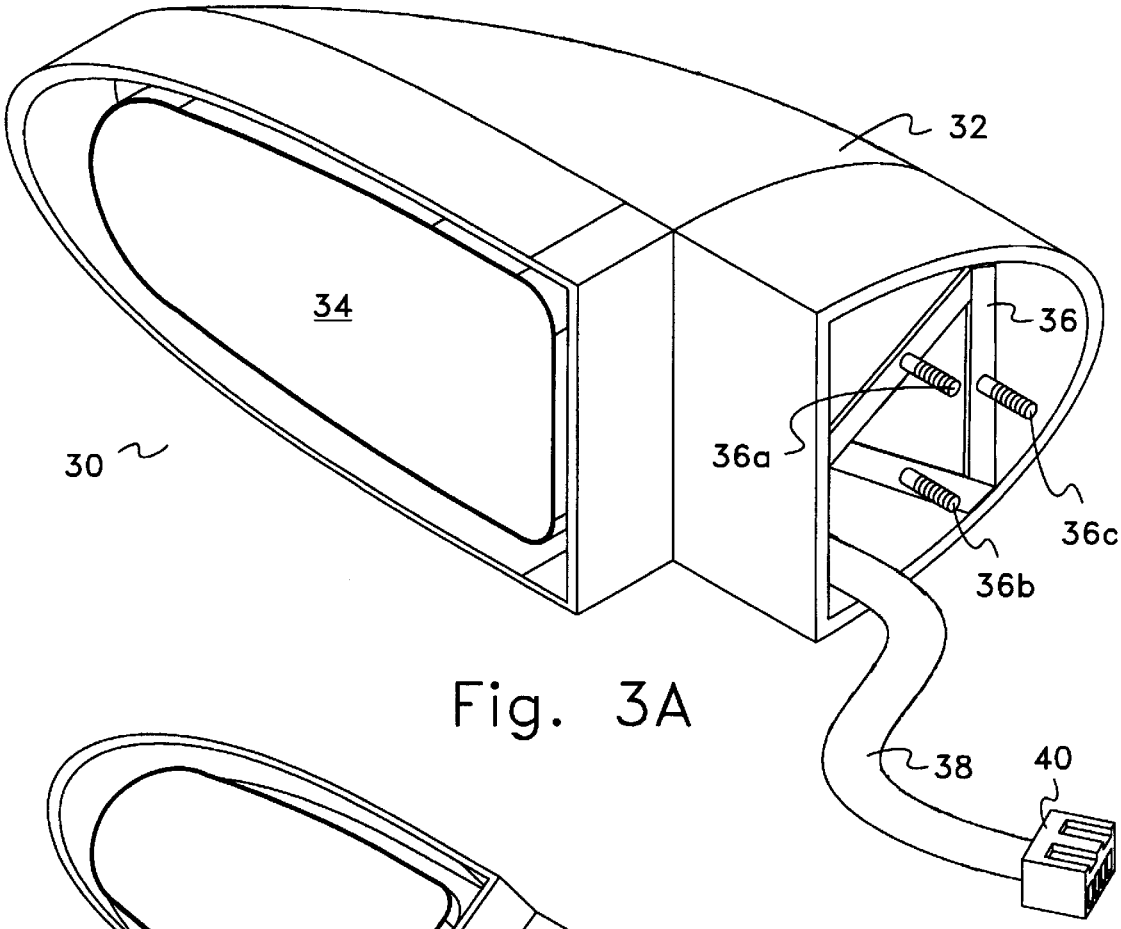
FIG. 3A is a perspective view of an automobile mirror assembly.
Figure 3B:
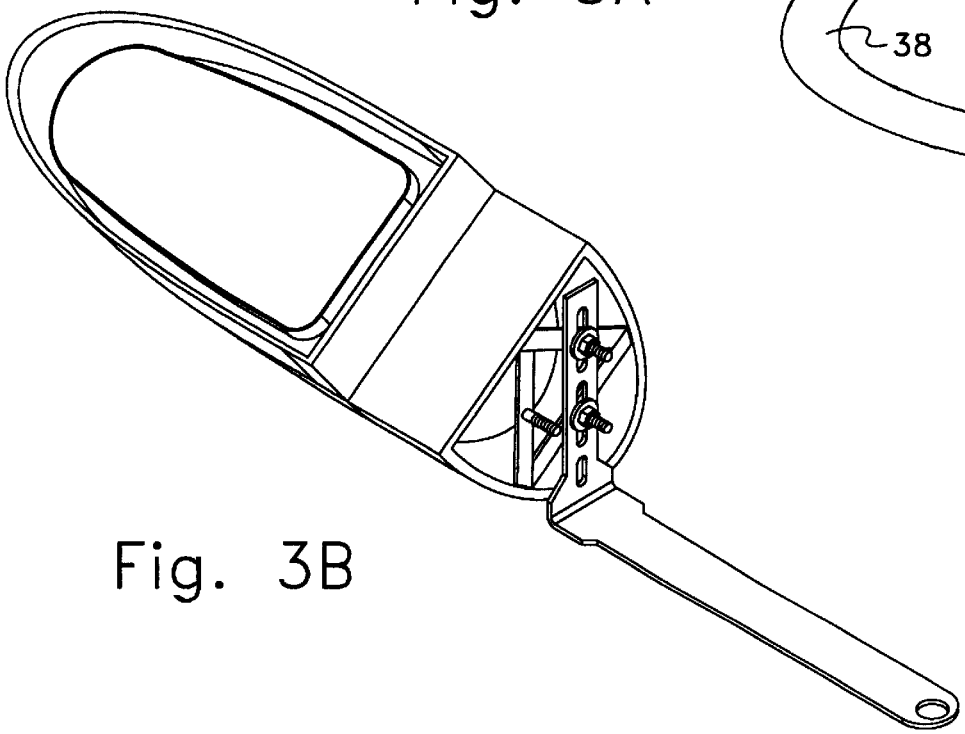
FIG. 3B is a perspective view of the mirror assembly mounted on the first example of a hand tool according to the invention.

FIG. 3A is a perspective view of an automobile mirror assembly 30, and is provided as an example of an article which can be advantageously painted using the hand tool 10 of the present invention. FIG. 3B is a perspective view of the mirror assembly mounted on the first example of a hand tool according to the invention. The mirror assembly 30 includes a housing 32 with a mirror 34 mounted therein. The mirror assembly 30 further includes a mounting bracket 36 having a pattern of bolts 36*a–c* protruding therefrom. The bolt pattern is adapted to be received in a door of a vehicle which provides a matching pattern of holes. The mirror assembly 30 is secured to the door with nuts, washers, and the like. An electrical cord 38 terminating in an electrical connector 40 extends from the housing 32 in the area of the bracket 36. During painting, the mirror 34 and the electrical connector 40 are masked.

According to the invention, at least one and preferably two of the bolts 36*a–c* are positioned through one or more of the slots 18*a–c* and the mirror assembly 30 is secured to the hand tool 10 with nuts, washers, and the like, as shown in FIG. 3B. The mirror assembly 30 is then held in fixed relationship with respect to hand tool 10 and may be maneuvered as described above. Namely, the operator can readily position the article relative to the spray gun as desired or needed during painting. Advantageously, the slots 18*a–c* are adapted to accommodate a wide range of bolt patterns and a single hand tool 10 according to the invention may be used for painting a wide variety of mirror assemblies, mud flaps, and other trim pieces from both foreign and domestic automobiles.

In the case of most mud flaps, some mirrors, and certain trim pieces, the article to be painted may not include mounting bolts, but instead includes a pattern of holes. In this case, one or more separate fasteners (e.g. bolts, nuts, washers if needed, and the like) are inserted through one or more holes, respectively, and the slots 18*a–c* to secure the article to be painted to the hand tool 10. For lightweight articles (e.g. less than 2 pounds or 1 kg), a single bolt is often sufficient to securely attach the article to the hand tool 10.

The electrical cord 36 is taped to the handle portion 14 during painting to prevent the cord 36 from interfering with the painting operation. For example, ¾ inch (18 mm) and 2 inch (50 mm) masking tape is readily in most paint shops. Advantageously, when the mirror assembly 30 is dry, the cord 36 may be pulled to tear through the masking tape and release the cord 36. The masking tape remaining on the handle 14 builds up over time but generally does not detract from the use of the handle 14 and may even improve the comfort of the handle 14 for the operator.

Paint may also build up on the hand tool 10 over time. Generally, such paint build up does not interfere with the use of the hand tool 10. Specifically, slots 18*a–c* are preferably wide enough to permit a substantial amount of paint build up and still accommodate the bolts of most mirrors. Where necessary or desired, the paint build up may be readily removed by filing, drilling, breaking off, or other machining.

Advantageously, when the spray painting is completed, the operator may directly hang the hand tool 10 by the bore 20 on a hook, hanger, post, or the like in the spray chamber without handling the article. The article is then safely an securely suspended during the drying process.

Figure 4:
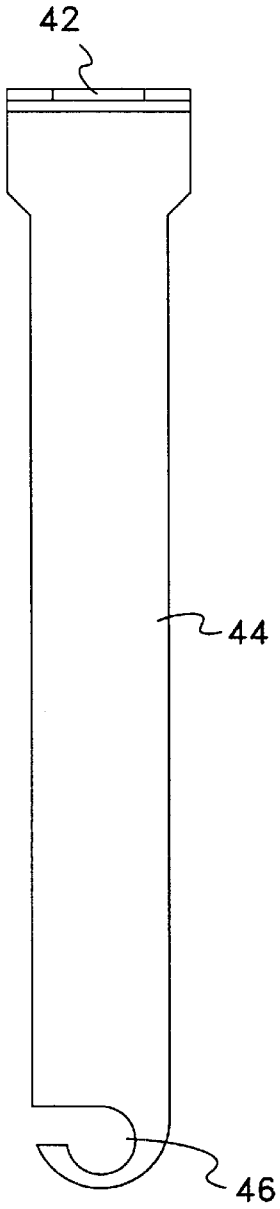
FIG. 4 is a front, schematic view of a second example of a hand tool according to the invention.

FIG. 4 is a front, schematic view of a second example of a hand tool according to the invention. The second example is similar to the first example including a mounting portion 42, a handle portion 44, and a supporting portion 46. The supporting portion 46 defines a hook in the general form of a bore and a slot through one side of the handle 44. The bore may be utilized to hang the hand tool from a hook or post on another fixture as described above with respect to the first example. Advantageously, the supporting portion 46 may also be utilized as a hook to hang the hand tool from a hole or on a lip if such hanging is more convenient with the other fixtures present in the spraying chamber. As compared to the first example, the second example thus provides more flexibility in how to hang the hand tool during the drying process.

Figure 5:
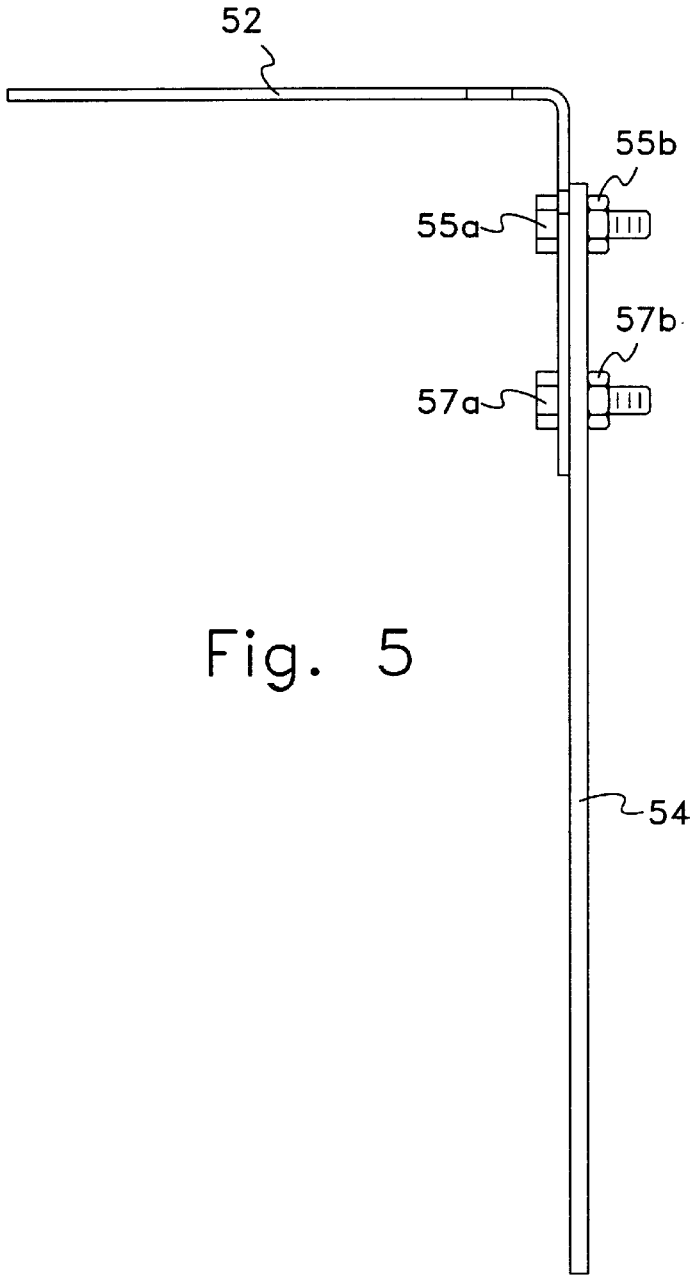
FIG. 5 is a side, schematic view of a third example of a hand tool according to the invention.

FIG. 5 is a side, schematic view of a third example of a hand tool according to the invention. The third example is similar to the first and second examples, except that the hand tool is made from two piece construction. A mounting portion 52 in the form of an L-shaped bracket is bolted to a handle portion 54 by bolts 55*a,* 57*a* and nuts 55*b,* 57*b*. Alternatively, the mounting portion 52 may be soldered, welded, brazed, riveted, or otherwise secured to the handle 54 by conventional means for joining two pieces of metal. The supporting portion for the third example is a bore as shown in the first example.

Figure 6A:
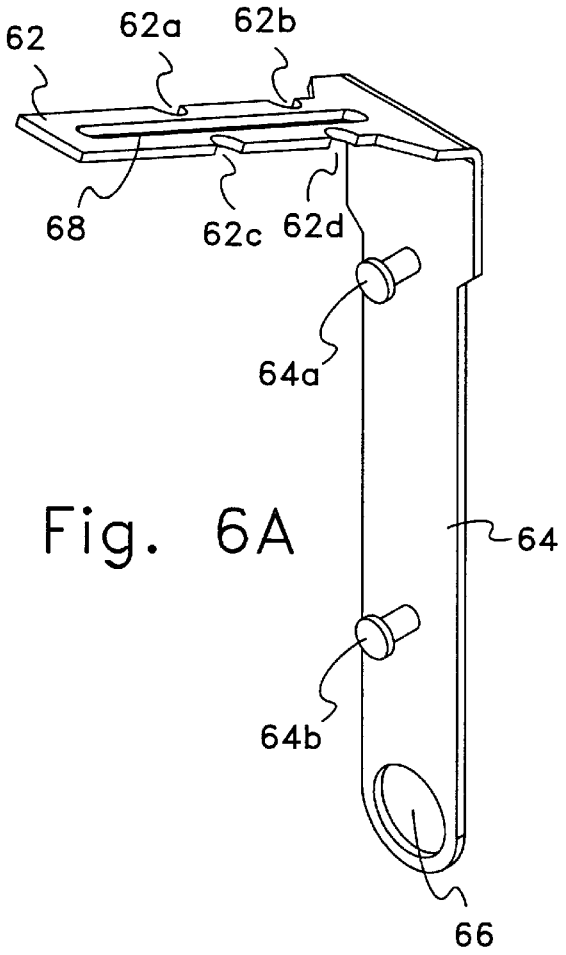
FIG. 6A is a perspective view of a fourth example of a hand tool according to the invention.
Figure 6B:
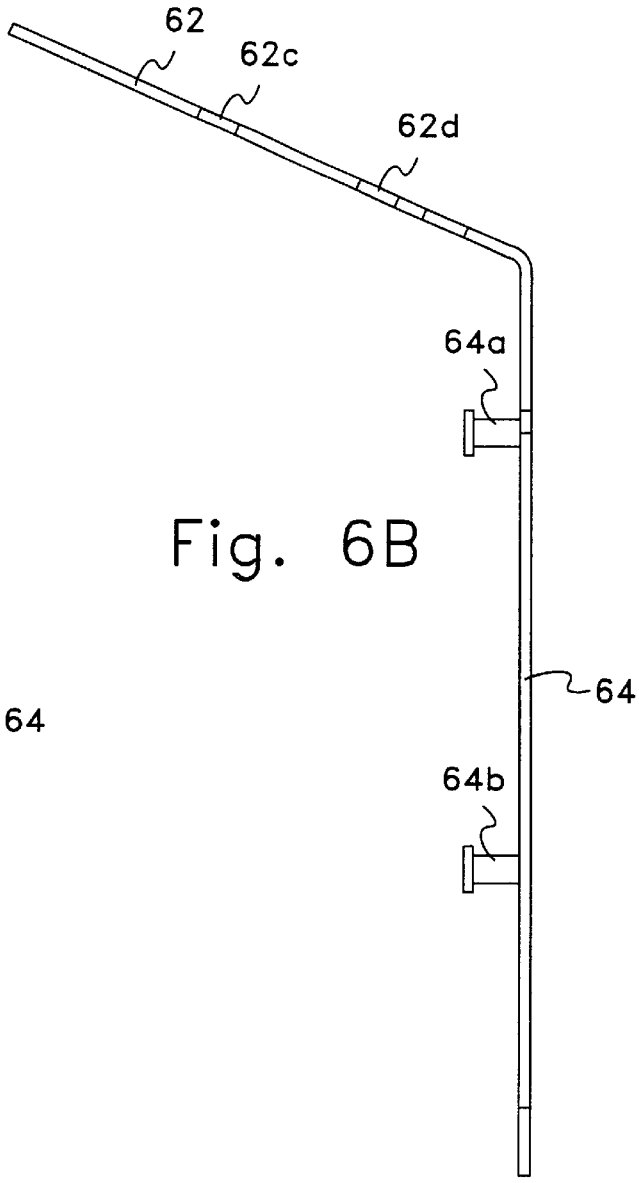
FIG. 6B is a side, schematic view of the fourth example.
Figure 6C:
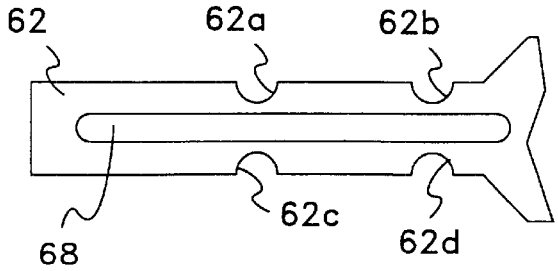
FIG. 6C is a top, schematic view of the fourth example.

FIGS. 6A–C are perspective, side, and top views, respectively, of a fourth example of a hand tool according to the invention. The fourth example is similar to the first through third examples with the following differences. A mounting portion 62 is positioned at an angle other than a right angle with respect to a handle portion 64. Although an exemplary angle is illustrated, any useful angle, includes acute angles, may be utilized. An angle other than a right angle may be more effective during the painting process depending on the particular article to be painted. Occasionally, the cord extending from the mirror assembly are relatively long. and therefore cumbersome to tape to the handle. The handle 64 includes one or more posts 64*a* and 64*b*. A long cord may be wrapped around the posts 64a and 64b prior to taping, thereby making the preparation process more efficient. A supporting portion 66 includes a bore which is relatively larger than the first through third examples. The mounting portion 62 defines a single elongated slot 68. A single slot 68 may improve the range of bolt patterns accommodated by the hand tool.

The mounting portion 62 also defines a plurality of notches 62*a–d*. The function of the notches 62*a–d* is to provide a location for positioning the electrical cord if the relationship between the bolt pattern and the electrical cord would otherwise cause interference with the mounting portion 62. Specifically, although mirror assembly 30 shows the bracket area as being relatively open, certain mirror assemblies are closed and provide for a small pre-defined opening for the cord 36. In such an assembly, the cord occasionally interferes with a desired positioning the mounting bolts on the hand tool. While such interference does not prevent effective utilization of the hand tool, it may be desirable to avoid such interference. As compared to the first example, the fourth example provides more flexibility in mounting the mirror assembly without interfering with the cord.

Figure 7:
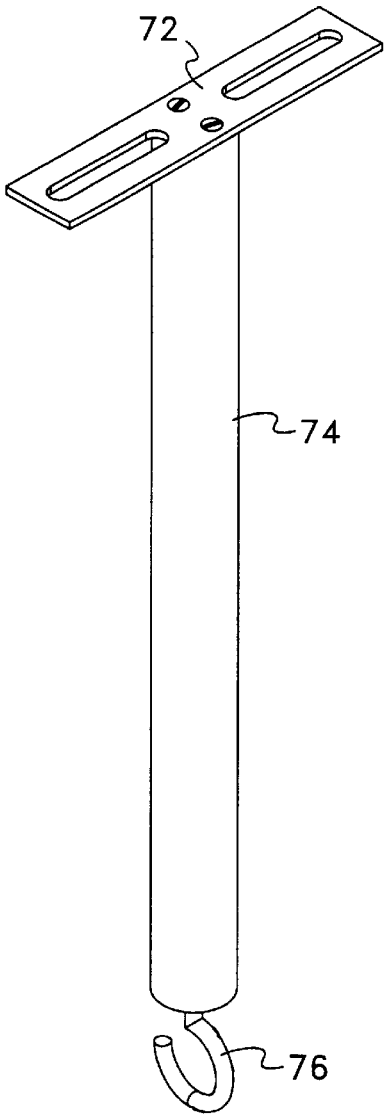
FIG. 7 is a perspective view of a fifth example of a hand tool according to the invention.
Figure 8:
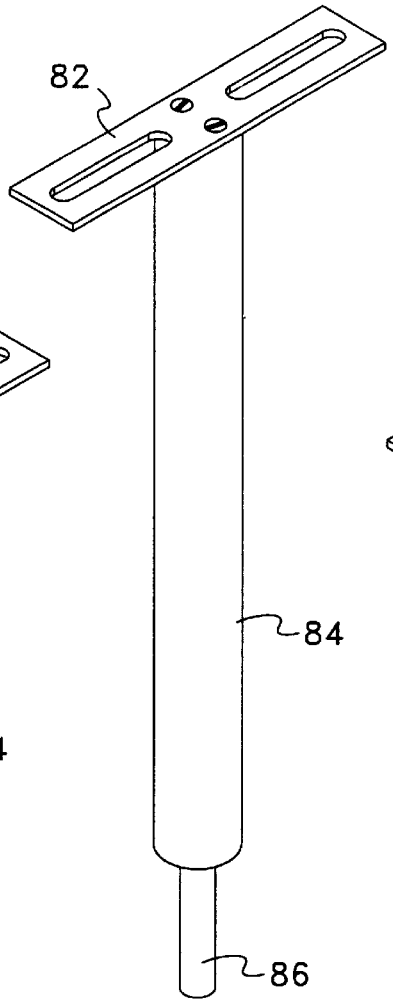
FIG. 8 is a perspective view of a sixth example of a hand tool according to the invention.
Figure 9:
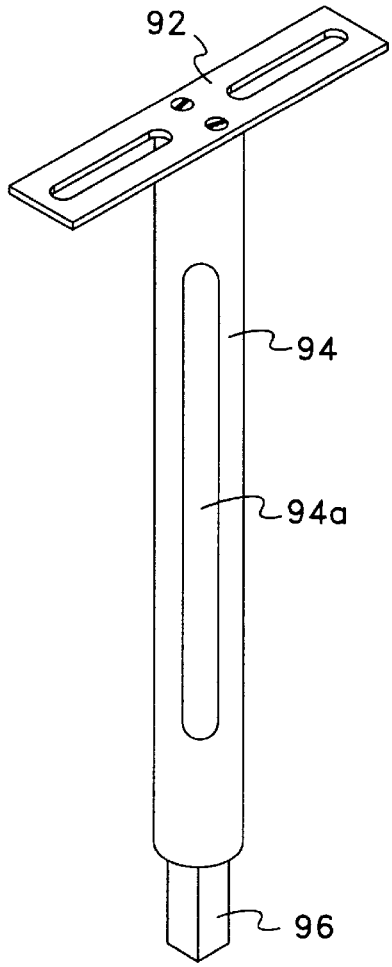
FIG. 9 is a perspective view of a seventh example of a hand tool according to the invention.
Figure 10:
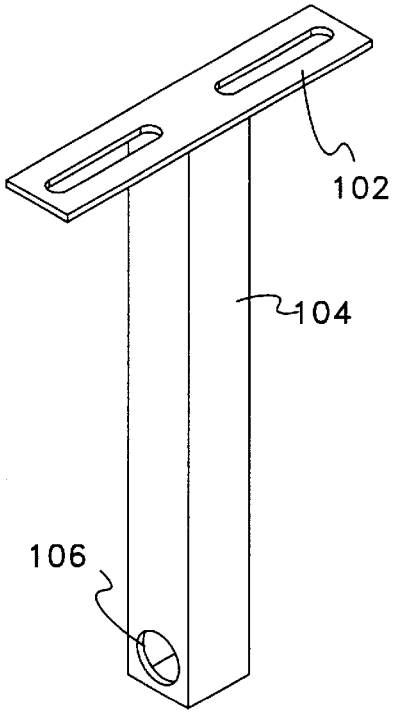
FIG. 10 is a perspective view of a eighth example of a hand tool according to the invention.
Figure 11:
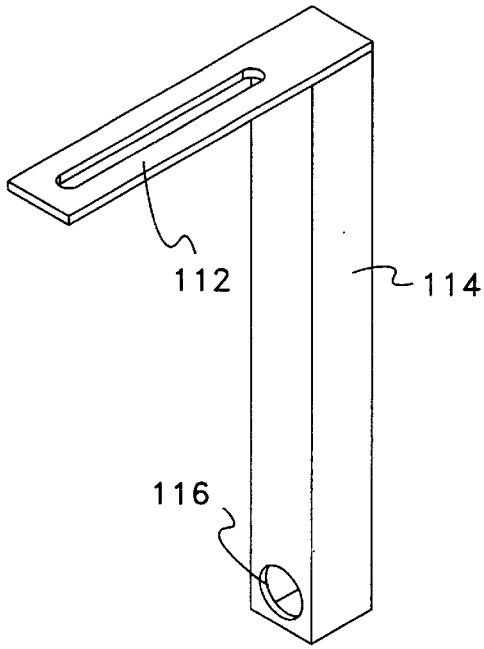
FIG. 11 is a perspective view of a ninth example of a hand tool according to the invention.
Figure 12:
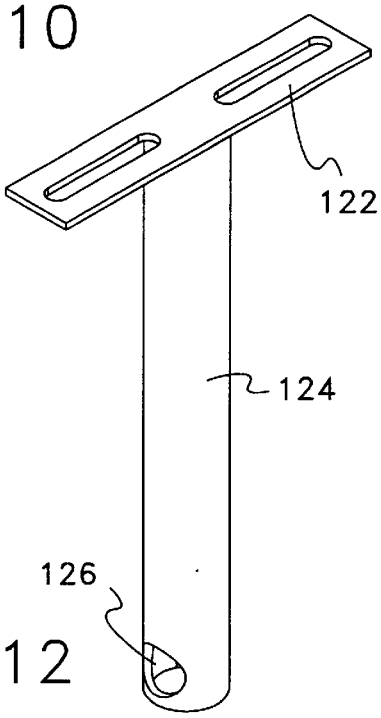
FIG. 12 is a perspective view of a tenth example of a hand tool according to the invention.
Figure 13:
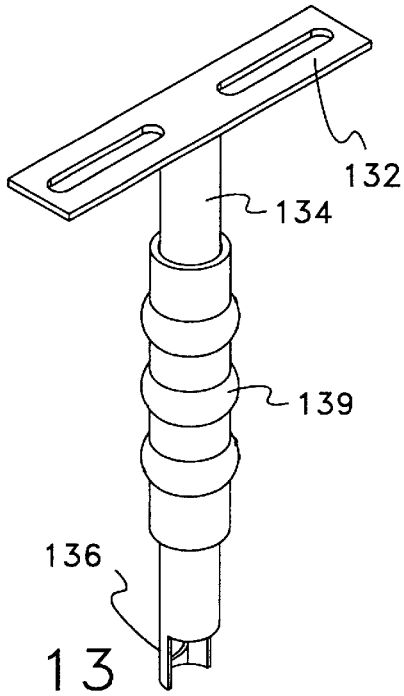
FIG. 13 is a perspective view of a eleventh example of a hand tool according to the invention.

FIGS. 7–8 are perspective views of fifth, sixth, and seventh examples, respectively, of a hand tool according to the invention. In each of the fifth through sevenths examples, the hand tool has a general "T" shape instead of the "L" shape of the previous examples. The construction of these examples is generally as follows. The mounting portion comprises a slotted bracket with counter-bored holes for attaching the bracket to a handle. The handle portion comprises a wooden dowel or hardwood handle. The bracket is secured to the handle with wood screws having tapered heads which recess into the counter-bored holes so that the heads of the screws are substantially flush with the top of the bracket. As compared to the first through fourth examples, the handle of the fifth through seventh examples may be more comfortable and ergonomic for the operator.

In the fifth example, the hand tool includes a bracket 72 secured to a wooden handle 74 as described above. The supporting portion,76 comprises a metal hook which is screwed into an end of the handle 74 distal to the bracket 72.

The sixth example is similar to the fifth example, including a bracket 82 secured to a wooden handle 84 as described above. The supporting portion 86 comprises a pin or rod which is adapted to cooperate with a hole or bore in a floor standing rack or wall mounted fixture in the spray chamber. The handle 84 may be drilled along its longitudinal axis through the end of the handle 84 distal to the bracket 82. The pin 86 is inserted into the drilled bore and glued or otherwise secured by conventional means. Alternatively, one end of the pin 86 may comprise a threaded portion which is screwed into the drilled bore.

Instead of hanging the article during the drying process the fixture of the sixth example supports the article in a more upright position. For example, many floor standing fixtures provide a plurality of sockets configured to accept rods, hangers, and the like. The pin 86 is configured to fit in such sockets. Typically, not all of the sockets on a rack are utilized for a particular paint job. The available sockets may be utilized by the hand tool according the sixth example, thereby improving the utilization of the rack.

The seventh example is similar to the sixth example, including a bracket 92 secured to a wooden handle 94 as described above. A supporting portion 96 comprises an elongated square peg. The peg 96 may be of one-piece construction with the handle 94, formed by milling or the like. The peg 96 is configured to fit in square sockets, and improves the utilization of floor standing racks equipped with such sockets. The seventh example also includes a channel 94*a* formed in the handle 94. For example, a router may be utilized to form the channel 94*a*. The channel 94*a* is adapted to receive the electrical cord from a mirror assembly in an area of the handle 94 which is grasped by the operator during painting. The cord is pressed into the channel 94*a* prior to taping the cord down and functions to improve the comfort of the handle for the operator during painting.

FIGS. 10–13 are perspective views of eighth, ninth, tenth, and eleventh examples, respectively, of a hand tool according to the invention. The construction of these examples is generally as follows. A slotted metal bracket is secured to a tubular metal handle by soldering, welding, brazing, or other conventional means for joining two pieces of metal.

The eighth example includes a mounting bracket 102 attached to a tubular handle 104 at the center of the bracket 102. The mounting bracket 102 includes two slots, with one on each side the centrally positioned handle 104. A supporting portion 106 includes a bore through the handle 104. The handle 104 has a square cross-section. The hand tool of the eighth example may be utilized to support the article during the drying process in at least three ways. First, the hand tool may be hung by the hole in the supporting portion 106. Second, the hand tool may be positioned over a rod, post or the like through the open end of the supporting portion 106, holding the tool in a more upright position. The rod is inserted in the hollow portion of the tubular handle 104. Third, the supporting portion 106 may be placed in a socket or like, holding the tool in a more upright position.

The ninth example is similar to the eighth example, including a mounting bracket 112 attached to a tubular handle 114 with a square cross section and a supporting portion 116 having a bore through the handle 114. The mounting bracket 112 defines a single elongated slot and is attached to the handle 114 on one end of the bracket 112, forming a general "L" shape.

The tenth example is similar to the eighth example, except that a tubular portion 124 has a circular cross section.

The eleventh example is similar to the tenth example, except that a grip 139 is disposed on a handle 134. Also, a supporting portion 136 has a portion of the handle 134 removed. The grip 139 improves the comfort of the hand tool for the operator.

While the invention has been described with respect to specific examples, variations will occur to those skilled in art having the benefit of the present specification. Moreover, while many features have been described above with respect to specific examples, such features may be readily adapted and combined to provide other embodiments of the invention having different combinations of such features. Accordingly, the foregoing description should be considered as illustrative and not limiting, with the scope and spirit of the invention being defined by the following claims.

What is claimed is:

1. A hand tool in combination with an article to be painted, comprising:

an article to be painted; and a hand tool, the hand tool comprising:

a mounting portion adapted to secure the article thereto during a painting operation;

a handle portion connected to the mounting portion, the handle portion being adapted to be grasped by an operator during the painting operation; and a supporting portion connected to the handle portion, the supporting portion being adapted to support the article after the painting operation is completed and while the paint dries, wherein the article includes a cord attached thereto and wherein the handle portion comprises at least one post extending therefrom for securing the cord during the painting operation.

2. The apparatus as recited in claim 1, wherein the article is removed from the hand tool after the paint dries and the hand tool is to be used for a next article to be painted.

3. The apparatus as recited in claim 1, wherein the article comprises a mirror assembly.

4. The apparatus as recited in claim 1, wherein the mounting portion comprises a planar bracket defining an elongated slot adapted to receive a fastener therethrough for securing the article to the bracket.

5. The apparatus as recited in claim 4, wherein the bracket defines a plurality of elongated slots.

6. The apparatus as recited in claim 4, wherein the mounting portion further defines at least one notch therein.

7. The apparatus as recited in claim 1, further comprising a defined grip portion in the area of the handle portion.

* * * * *